US009873150B2

(12) United States Patent
Ren et al.

(10) Patent No.: US 9,873,150 B2
(45) Date of Patent: Jan. 23, 2018

(54) METHOD AND DEVICE FOR CONTINUOUS THIN STRIP CASTING

(71) Applicant: BAOSHAN IRON & STEEL CO., LTD., Shanghai (CN)

(72) Inventors: Sanbing Ren, Shanghai (CN); Yuan Fang, Shanghai (CN); Junfei Fan, Shanghai (CN); Yan Yu, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 228 days.

(21) Appl. No.: 14/429,743

(22) PCT Filed: Sep. 27, 2012

(86) PCT No.: PCT/CN2012/001312

§ 371 (c)(1),
(2) Date: Mar. 19, 2015

(87) PCT Pub. No.: WO2014/047745

PCT Pub. Date: Apr. 3, 2014

(65) Prior Publication Data

US 2015/0251244 A1 Sep. 10, 2015

(30) Foreign Application Priority Data

Sep. 25, 2012 (CN) ..... 2012 1 0362387

(51) Int. Cl.
*B22D 41/08* (2006.01)
*B22D 11/10* (2006.01)
(Continued)

(52) U.S. Cl.
CPC ..... *B22D 11/10* (2013.01); *B22D 11/001* (2013.01); *B22D 11/0622* (2013.01);
(Continued)

(58) Field of Classification Search
CPC ..... B22D 41/01; B22D 41/015
(Continued)

(56) References Cited

U.S. PATENT DOCUMENTS 4,645,534 A * 2/1987 D'Angelo ..... B22D 1/00 164/469
5,381,854 A * 1/1995 Thomson ..... B22D 11/18 164/155.3
(Continued)

FOREIGN PATENT DOCUMENTS

CN 101637813 2/2010
CN 102009143 4/2011
(Continued)

*Primary Examiner* — Scott Kastler
(74) *Attorney, Agent, or Firm* — Eversheds Sutherland (US) LLP

(57) ABSTRACT

A method for continuous thin strip casting comprises: introducing molten steel through a long nozzle into a tundish from a ladle, the tundish is one strand tundish, and the molten steel flows below a weir, then passes a first dam and enters a channel with an induction heating device, and the heated molten steel then flows out from an outlet at the other side of the tundish to a nozzle also with an induction heating device for casting. The distances between the weirs of the tundish and the channel have optimal distance ranges. The present invention can improve the casting stability and the quality of the casting strip.

9 Claims, 3 Drawing Sheets

(51) Int. Cl.

| | |
|---|---|
| ***B22D 11/06*** | (2006.01) |
| ***B22D 41/01*** | (2006.01) |
| ***B22D 41/015*** | (2006.01) |
| ***B22D 11/00*** | (2006.01) |
| ***B22D 41/60*** | (2006.01) |
| ***B22D 11/118*** | (2006.01) |

(52) U.S. Cl.
CPC ..... *B22D 11/118* (2013.01); *B22D 41/01* (2013.01); *B22D 41/015* (2013.01); *B22D 41/60* (2013.01)

(58) Field of Classification Search
USPC ..... 266/275
See application file for complete search history.

(56) References Cited

U.S. PATENT DOCUMENTS 5,437,434 A * 8/1995 Ao ..... B22D 41/01
222/593
5,511,766 A * 4/1996 Vassilicos ..... B22D 11/11
266/227

FOREIGN PATENT DOCUMENTS

| | | |
|---|---|---|
| CN | 201922007 | 8/2011 |
| CN | 102896285 | 1/2013 |
| EP | 0726115 | 8/1996 |
| JP | 2010-89153 | 4/2010 |

* cited by examiner

METHOD AND DEVICE FOR CONTINUOUS THIN STRIP CASTING

CROSS-REFERENCE TO RELATED APPLICATIONS

This application claims priority to and benefit of PCT Application No. PCT/CN2012/001312, entitled "Method and Device for Continuous Thin Strip Casting," filed Sep. 27, 2012, which claims the benefit of Chinese Patent Application No. 201210362387.6 filed on Sep. 25, 2012, which are both incorporated herein by reference in their entirety.

TECHNICAL FIELD

The present invention relates to the field of continuous thin strip casting, which specifically relates to method and device for continuous thin strip casting.

BACKGROUND

In recent decades, with the improvement in both the continuous casting technology and the online computer control degree, it has become a wish of metallurgical industry of countries in the world to lower the energy consumption and manufacturing cost of the steel industry. Therefore, casting molten steel directly into finished products has become a goal pursued by researchers.

One of the main manners of continuous thin strip casting is that the molten steel passes through a crystallization roller in high-speed revolution and solidifies into cast strips of 2-5 mm under the rolling force. The basic technological process of current continuous thin strip casting is: thin strip continuous casting device (twin-roller, single-roller and wheel-belt type)→closed chamber→loop→pinch roller→hot rolling (single-stand, twin-stand or none)→controlled cooling→coiling. Introducing the molten steel from a steel ladle through a long nozzle, a tundish and a submersed nozzle to a molten pool formed by rotating water-cooling crystallization rollers and side dams, then forms cast strips through cooling by water-cooling crystallization rollers. After that, delivering the cast strips to a cast strip conveying roller pass by the swinging guide plate and the pinch roller, and then reach a coiling machine by the hot rolling mill, spray cooling and flying shear.

By virtue of advantages like cost saving, plant area reduction, energy consumption reduction, production efficiency improvement, etc., the continuous thin strip casting technology has become a hot subject among researchers all over the world, and it is called a revolutionary technology of the metallurgical industry.

At present, continuous thin strip casting mainly ha two problems: (1) at the preliminary stage of pouring, the high-temperature molten steel tends to solidity when flowing from the tundish nozzle into a delivery device and from a small hole of the delivery device to a space between twin rollers; (2) in the process of pouring the molten steel for a long time, the molten steel flowing from the ladle to the tundish goes through significant temperature decline and may solidify in severe cases.

SUMMARY

The object of present invention is providing method and device for continuous thin strip casting, which can realize constant-temperature pouring of continuous thin strip casting and overcome the problem of quality difference of rolls before and after, and the constant-temperature pouring can stabilize both the pulling speed of the thin strip and the condition of the molten pool, and thus avoid quality defects caused by speed changes. It can also fully facilitate the inclusions in the molten steel to float upwardly to improve quality of the cast strip; reduce the superheat degree of the molten steel in the ladle to reduce the consumption of energy, improve the quality of the molten steel and decrease the wastage of refractory material; and lessen the formation of the cold steel on the surface of the molten pool at the preliminary stage of pouring, so as to facilitate it entering into the normal pouring stage immediately.

To achieve above object, the technical solution of present invention as described below:

A method for continuous thin strip casting, comprises: introducing molten steel through a long nozzle into a tundish from a ladle, and heating the molten steel in a manner of externally heating the tundish, so as to maintain the molten steel at a basically constant temperature in entire pouring process. The tundish is a one strand tundish, and the molten steel flows below a weir which is located at one side in the tundish, then passes a first dam and enters a channel with an induction heating device, and a temperature of the molten steel after induction heating is 30~50 higher than that at the time of introduced into the tundish, and the heated molten steel then flows out from a outlet at the other side of the tundish to a nozzle for casting.

Further, a nozzle induction heater is disposed outside of the nozzle.

The distance between the induction heater disposed outside of the nozzle and an upper port of the nozzle is ½~⅔ of that between an inlet and an outlet of the tundish.

And as well, the molten steel after induction heating passes a second dam and then flows out from the outlet at the other side of the tundish for casting.

A tundish used for continuous thin strip casting in the present invention, wherein the tundish is provided inside with a tundish inlet, a weir, a first dam, a retaining wall which separates the tundish into two chambers and a tundish outlet in this order; the retaining wall is provided inside with a channel which impenetrates two chambers; and in the retaining wall, the channel is surrounded by an induction heater, which comprises an iron core, a coil, refractory material and a tube.

Further, the chamber corresponding to the tundish outlet is also provided with a second dam.

The distance between the tundish inlet and the retaining wall is ½~⅔ of a distance between the tundish inlet and the tundish outlet.

The distance between the retaining wall and the tundish outlet is ¼~⅔ of a distance between the tundish inlet and the tundish outlet.

The distance between the weir and the retaining wall is ⅓~⅔ of a distance between the tundish inlet and the retaining wall.

The distance between the first dam and the retaining wall is ¼~½ of a distance between the tundish inlet and the retaining wall.

The present invention involves a method for continuous thin strip casting, comprises: introducing the molten steel in the ladle into the tundish, which can heat the molten steel externally to maintain the outflowing molten steel at a basically constant temperature. The tundish is a one strand tundish, and providing at the bottom of the tundish corresponding to the nozzle with a turbulence inhibitor, a tubular heater is provided behind the turbulence inhibitor, and a dam is provided behind the tubular heater so as to eliminate inclusions and achieve a uniform temperature. The power of the tubular heater can be regulated, at the preliminary stage, a high power is used to heat the molten steel flowing through the channel so as to increase its temperature to a level of 30~50 C above the original superheat degree within a short time; at outside of the nozzle, an induction heating device is also provided to maintain the temperature of the molten steel at 30~50 C above the original superheat degree. In this way, at the preliminary stage, the molten steel of a relatively high superheat degree flows into the delivery device, and smoothly flows into the molten pool through the small hole of the delivery device without solidification. At later stage, after the building of the molten pool between twin rollers, it's necessary to reduce the power of the electromagnetic induction heating devices of the tundish and that at outside of the nozzle, for the purposes of maintaining the molten steel at a normal superheat degree and realizing long-term constant-temperature pouring in continuous thin strip casting without premature solidification.

The induction heater comprises an iron core, a coil, refractory material and a tube, and basic principle thereof is: after switching on the electrical source, an induced magnetic field is generated in the iron core due to the motion of current in the coil, and when the molten steel passes through the magnetic field in the channel, its movement cuts across the magnetic field and generates induction heat and thus heat the molten steel.

The induction heater may be freely regulated between the maximum power and the minimum power. At the preliminary stage, start of pouring of the thin strip requires a relatively high initial temperature, and the induction heating device is set at a high power to increase the temperature of the molten steel introduced into the tundish by 30~50 C within a short time; when the molten pool between twin rollers establishes its liquid level, the power of the tabular heater may be set to a relatively low level, and the original superheat degree of the molten steel may be used for pouring; after a relatively long period of pouring for continuous thin strip casting, the tabular heater may be set to a medium power to provide temperature compensation for the low-temperature molten steel, so as to maintain the temperature of the molten steel at basically the same level at the normal pouring stage.

The power of the nozzle heater is switched on at the preliminary pouring stage, and switched off in the normal pouring process. In the process of pouring start, the temperature of the molten steel flowing through the nozzle is increased by 2~10 C with respect to the normal temperature.

Beneficial Effects of the Present Invention:

1. By present pouring method, constant-temperature pouring in continuous thin strip casting can be realized, which may overcome quality difference of rolls before and after, and can stabilize both the pulling speed of the thin strip and the condition of the molten pool, and thus avoid quality defects caused by speed changes;
2. By present pouring method, fully facilitate the inclusions in the molten steel to float upwardly, so as to improve quality of the cast strip;
3. By present pouring method, can reduce the superheat degree of the molten steel in the ladle to reduce the consumption of energy, improve the quality of the molten steel and decrease the wastage of refractory material;
4. By present pouring method, can lessen the formation of the cold steel on the surface of the molten pool at the preliminary stage of pouring, so as to facilitate it entering into the normal pouring stage immediately;
5. By present pouring method, can expand the pouring scope of steel grades used for continuous thin strip casting.

EMBODIMENTS

Figure 1:
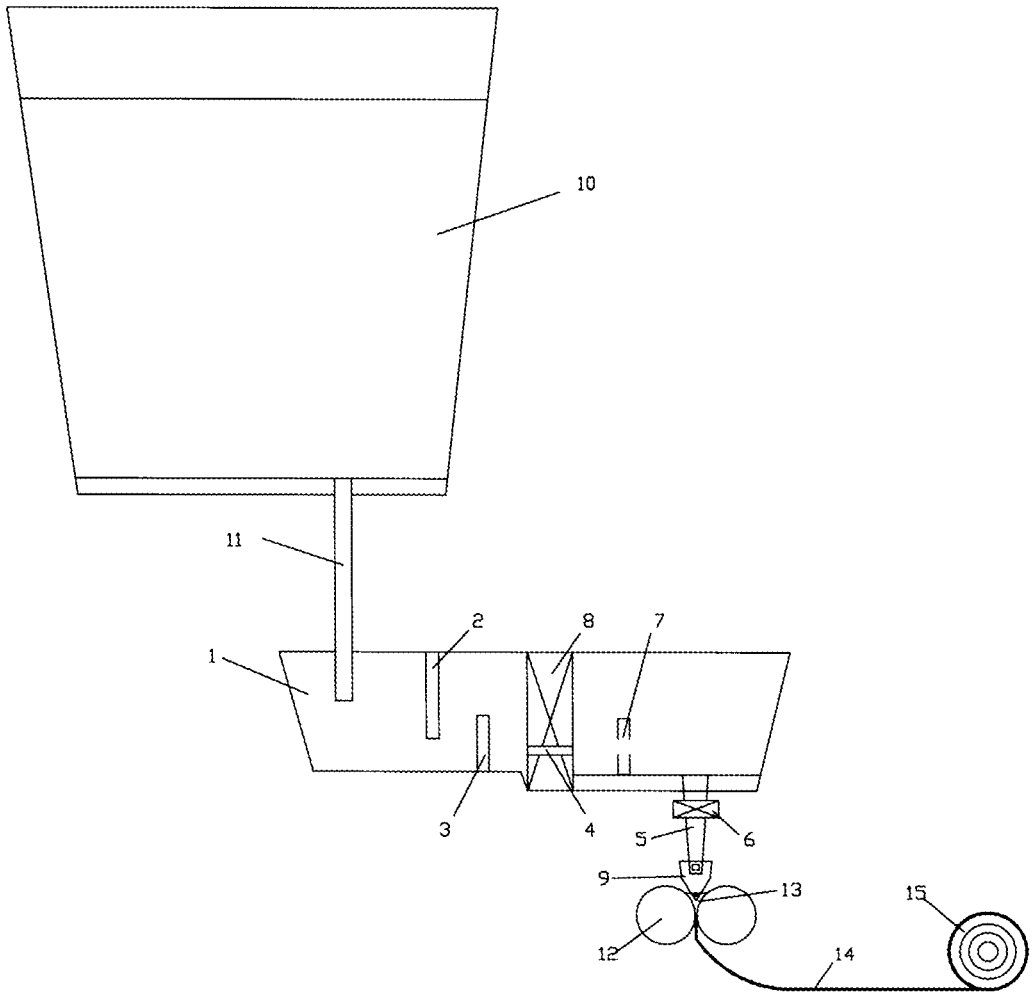
FIG. 1 is a structural schematic diagram of an embodiment of present invention.
Figure 2:
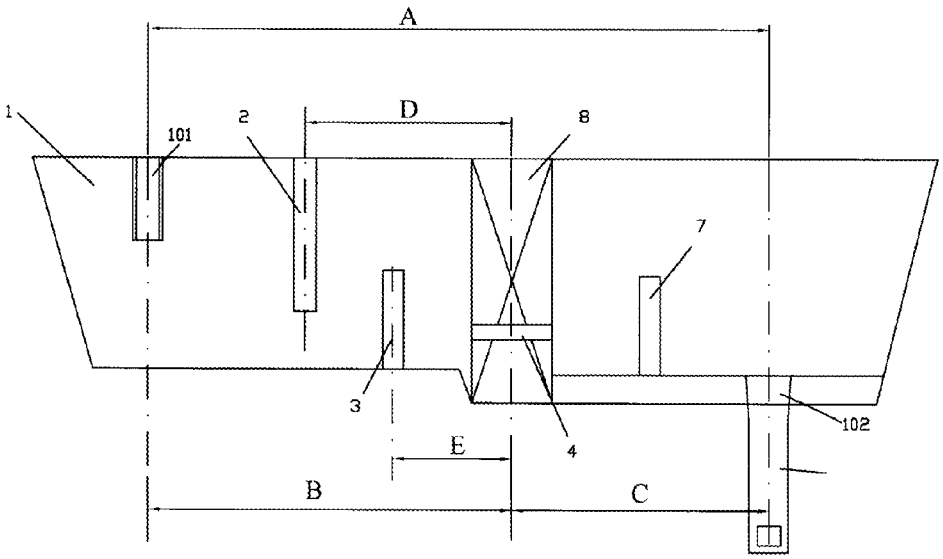
FIG. 2 is a structural schematic diagram of the tundish in the embodiment of the present invention.
Figure 3:
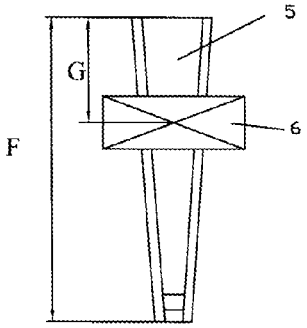
FIG. 3 is a structural schematic diagram of the nozzle in the embodiment of the present invention.
Figure 4:
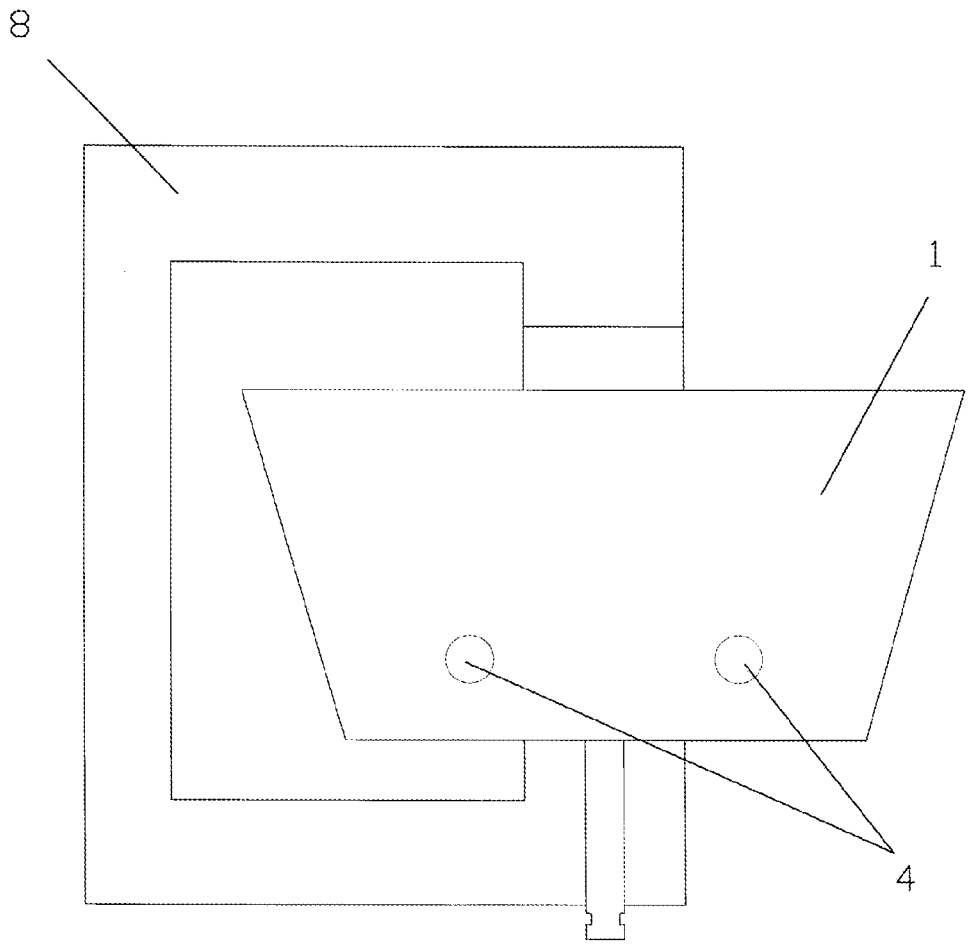
FIG. 4 is a structural schematic diagram of the tundish induction heater in the embodiment of the present invention.

As shown in FIG. 1~FIG. 4, the present invention relates to a method for continuous thin strip casting, wherein the molten steel is introduced into a tundish 1 from the ladle through the long nozzle. The tundish is a one strand tundish, and the molten steel flows below a weir 2 which is located at on one side in the tundish 1, then passes a first dam 3 and enters a channel 4 with an induction heating device; and a temperature of the molten steel after induction heating is 30~50 C higher than that at a time of it is introduced into the tundish, and the heated molten steel then flows out from a outlet on the other side of the tundish 1 into the nozzle 5 for casting.

Further, a nozzle induction heater 6 is disposed outside of the said nozzle 5.

The distance between the induction heating device disposed outside of the nozzle and an upper port of the nozzle is ½~⅔ of that between an inlet and an outlet of the tundish.

Further, the molten steel after induction heating passes a second dam 7 and then flows out from the outlet at the other side of the tundish for casting.

A tundish used for continuous strip casting in the present invention, wherein the tundish 1 is provided inside with the tundish inlet 101, the weir 2, the first dam 3, the retaining wall 100 which separates the tundish into two chambers and the tundish outlet 102 in this order; the retaining wall 100 is provided inside with a channel 4 which impenetrating two chambers; and the retaining wall around the steel channel 4 is provided inside with an induction heater 8.

Further, the chamber corresponding to the tundish outlet 101 is also provided with a second dam 7.

A distance B between the tundish inlet and the retaining wall is ½~⅔ of a distance A between the tundish inlet and the tundish outlet. A distance C between the retaining wall and the tundish outlet is ¼~⅔ of the distance A between the tundish inlet and the tundish outlet. A distance D between the weir and the retaining wall is ⅓~⅔ of the distance B between the tundish inlet and the retaining wall. The distance E between the first dam and the retaining wall is ¼~½ of the distance B between the tundish inlet and the retaining wall.

According to the capacity of the ladle 10 and considering the temperature decline of the ladle 10, the temperature of the molten steel is heated to a superheat degree of 50~100 C, and the molten steel is introduced through the long nozzle 11 into the tundish 1. After the molten steel passes through the weir 2 and the first dam 3, then flows into the channel 4 which is induction heated by the induction heater 8; the heater heats the molten steel flowing through the channel by an external power source.

At the preliminary stage of pouring, the induction heater 8 is set at a high power to increase the temperature of the molten steel in the tundish 1 by 30~50 C. Besides, a nozzle induction heater 6 is provided at outside of the nozzle 5 to heat the molten steel passing through the nozzle 5 at the preliminary stage of pouring. In this way, at the preliminary stage, a superheat degree of the molten steel entering into the nozzle 5 and delivery device 12 can reach 80~150 C. The chances of condensation of the high-temperature molten steel have been reduced when flowing through the small hole of the delivery device, the pouring process can be smoothly carried out.

When the molten steel ceaselessly flows from the delivery device 9 to the location between twin rollers 12, the molten steel in the molten pool between twin rollers 12 accumulates and forms a molten pool 13, and when the liquid level of the molten pool 13 reaches a certain height, the heat accumulation of both the nozzle 5 and delivery device 9 becomes adequate. At this moment, the power of the induction heater 8 in the tundish 1 is lowered, so that the molten steel is poured with a normal superheat degree, and the electrical source of the nozzle induction heater 6 is switched off In case of long-time pouring, according to the requirement of maintaining a basically stable superheat degree for the molten steel, the power of the induction heating device 8 is regulated to realize constant-temperature pouring in casting process. The molten steel solidifies between twin rollers 12, forms a shell, and then forms a cast strip 14 through extrusion by twin rollers, and finally produces a coil 15 through coiling by a coiling machine.

Continuous thin strip casting technology is one of the most competitive technologies in the $21^{th}$ century, and has many incomparable advantages compared with conventional continuous casting, such as energy conservation, environmental protection, etc., so it is increasingly emphasized by various countries in the world. As the tundish and delivery device pouring system constitute the key process and device in continuous thin strip casting, the present invention, by proposing the above method and device, will improve the stability of continuous thin strip casting significantly and lay a solid foundation for the successful realization of continuous thin strip casting.

The invention claimed is:

1. A method for continuous thin strip casting comprising:

providing molten steel by pouring the molten steel from a ladle through a long nozzle into a tundish; and heating the molten steel by heating a channel inside the tundish through which the molten steel flows to maintain the molten steel at an approximately constant temperature during the pouring, wherein a first induction heater is disposed outside of a nozzle disposed at a first side of the tundish, wherein further, the molten steel flows below a weir located at the first side of the tundish;

the molten steel passes a first dam and enters the channel, the channel having a second induction heater for induction heating of the molten steel, wherein further, a temperature of the molten steel after induction heating is 30~50° C. higher than that of the molten steel provided into the tundish; and the induction heated molten steel flows out from an outlet at a second side opposite the first side of the tundish to the nozzle for casting the induction heated molten steel.

2. The method for continuous thin strip casting according to claim 1, wherein a distance between the first induction heater disposed outside of the nozzle and an upper port of the nozzle is approximately ½ to approximately ⅔ of the distance between an inlet and an outlet of the tundish.

3. The method for continuous thin strip casting according to claim 1, wherein the molten steel after induction heating passes a second dam and the molten steel flows out from the outlet at the second side of the tundish for casting.

4. A tundish for continuous thin strip casting, wherein the tundish comprises a tundish inlet, a weir, a first dam, a retaining wall separating the tundish into two chambers, a tundish outlet, and a nozzle disposed proximate to the tundish outlet;

wherein the retaining wall is provided inside the tundish with a channel which impenetrates two chambers;

wherein the channel is surrounded by a first induction heater, the first induction heater comprising an iron core, a coil, a refractory material and a tube; and wherein a second induction heater is disposed outside of the nozzle;

wherein the tundish is further configured such that, molten steel flows below the weir located at a first side of the tundish;

the molten steel passes the first dam and enters the channel, where the first induction heater induction heats the molten steel, wherein further, a temperature of the molten steel after the induction heating by the first induction heater is 30~50° C. higher than that of the molten steel provided into the tundish; and the induction heated molten steel flows out from the tundish outlet at a second side opposite the first side of the tundish to the nozzle for casting the induction heated molten steel.

5. The tundish for continuous thin strip casting according to claim 4, wherein the tundish further comprises a second dam.

6. The tundish used for continuous thin strip casting according to claim 4, wherein a distance between the tundish inlet and the retaining wall is approximately ½ to approximately ⅔ of a distance between the tundish inlet and the tundish outlet.

7. The tundish for continuous thin strip casting according to claim 4, wherein a distance between the retaining wall and the tundish outlet is approximately ¼ to approximately ⅔ of a distance between the tundish inlet and the tundish outlet.

8. The tundish for continuous thin strip casting according to claim 4, wherein a distance between the weir and the retaining wall is approximately ⅓ to approximately ⅔ of a distance between the tundish inlet and the retaining wall.

9. The tundish for continuous thin strip casting according to claim 4, wherein a distance between the first dam and the retaining wall is approximately ¼ to approximately ½ of a distance between the tundish inlet and the retaining wall.

* * * * *